United States Patent [19]

Herklotz et al.

[11] 4,129,765

[45] Dec. 12, 1978

[54] ELECTRICAL SWITCHING CONTACT

[75] Inventors: Günther Herklotz, Bruchköbel; Walter Reichelt, Hanau, both of Germany

[73] Assignee: W. C. Heraeus GmbH, Hanau am Main, Germany

[21] Appl. No.: 822,729

[22] Filed: Aug. 8, 1977

[30] Foreign Application Priority Data

Aug. 25, 1976 [DE] Fed. Rep. of Germany ..... 2638135

[51] Int. Cl.[2] ..... H01H 1/66

[52] U.S. Cl. ..... 200/268

[58] Field of Search ..... 200/268, 269

[56] References Cited

U.S. PATENT DOCUMENTS

| | | | |
|---|---|---|---|
| 3,813,508 | 5/1974 | Toshiki | 200/268 |
| 3,889,098 | 6/1975 | Steinmetz | 200/268 |

*Primary Examiner*—Donald F. Norton

*Attorney, Agent, or Firm*—Flynn & Frishauf

[57] ABSTRACT

The present invention provides low-current carrying rem-reed switch contacts, preferably for operation under vacuum or under a protective gas. The contacts comprise a medium-hard magnetic material substrate which may contain anomalies on the surface. These are covered by an intermediate layer from 1 to 20 μm of at least one metal selected from the group consisting of titanium, zirconium, hafnium, vanadium, niobium and tantalum. This intermediate layer is then covered with a noble metal layer, for example alloys of gold or silver, and preferably by ruthenium.

15 Claims, 2 Drawing Figures

ELECTRICAL SWITCHING CONTACT

Figure 2:
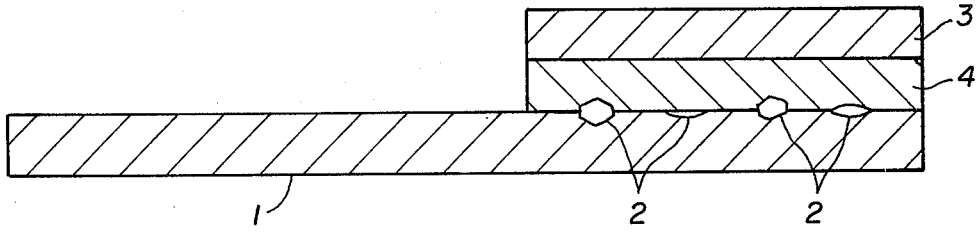

The present invention relates to an electrical low-power switch contact particularly suitable for operation under vacuum or under protective gas.

Electric low-power switch contacts of this type are disclosed in German Auslegeschrift 1,764,233. The switch comprises a substrate of soft magnetic material covered by an intermediate layer of molybdenum, tungsten, rhenium, a carbide or boride of these metals, tantalum carbide or tantalum boride, said intermediate layer being covered with an outer contact layer of a gold-palladium alloy. The outer contact layer is disclosed as being up to 0.02 mm thick. Such a low-power switch contact having the intermediate layer has the capacity to carry higher loading than a similar switch without the intermediate layer. Additionally, the presence of the intermediate layer substantially decreases the characteristic of the contact surface to hold (adhere) particles. The presence of the intermediate layer in the switch, thus, has a meaningful effect on the switching function.

German Auslegeschrift No. 1,160,060 discloses electrical switch contacts having a ferromagnetic substrate which operate under a protective or a noble gas. A base metal contact layer of a high-melting pointing metal having a thickness between several thousandths and several hundredths of a millimeter is rolled on such a substrate. This base metal contact layer is covered with a gold layer which is thin in comparison with the base metal contact layer. The purpose of the gold outer layer is to stop or minimize absorption of impurities.

Switches have been proposed in which the substrate is a magnetic medium-hard material with the material having a coercive field strength of from 20 to 90 Oe covered with a surface contact layer of a noble metal. Such switch contacts having the magnetic medium-hard material substrate have suffered from the disadvantage that the surface of the substrate contains localized irregularities which might also be characterized as imperfections or anomalies and are characterized by high transition resistance with consequent adverse effect on the switching function including switching errors. These anomalies are considered to be formed of titanium oxide or aluminum oxide including materials, sometimes with metal embedded therein. These anomalies may have a small cross-sectional area, for example of several $\mu m^2$ or particles of from 1 to 50 $\mu m$ diameter, with the tip protruding a few $\mu m$ from the surface of the substrate. Removal of these extruding tips by grinding (or polishing) or etching is not possible. Grinding results in breaking out a portion of the particles leaving a crater. Removal by etching also leaves a surface containing craters.

The Bell laboratories Record, June 1965, pages 260–261, discloses medium-hard magnetic materials containing about 2–5%, e.g., 3.5% vanadium, about 0.5% manganese, with iron and cobalt each making up 50% of the remainder.

It is an object of the present invention to provide electrical switch contacts of the low-power type comprising a medium-hard magnetic material substrate with the possibility that oxide particles may be formed during the manufacturing process of the reed blades and a contact layer of a noble metal (or a noble metal alloy or a noble metal base alloy) which has improved switching characteristics and an improved service life.

THE INVENTION

The present invention provides rem-reed-switch contacts comprising a medium-hard magnetic material which has a coercive field strength of from 20 to 90 Oe (the abbreviation for Oersteds) as the substrate, coated with at least one metal selected from the group consisting of titanium, zirconium, hafnium, vanadium, niobium and tantalum in a thickness of from 1 to 20 $\mu m$ (and preferably between 2 and 10 $\mu m$); with an outer contact layer of a gold-base alloy or a silver-base alloy, or rhodium or ruthenium. Ruthenium is the preferred material for the outer contact layer which covers the intermediate layer.

It has been unexpectedly discovered that the aforesaid low-power switch contacts of the present invention which contain anomalies on the surface of the substrate perform their switching function in a satisfactory manner without the switching errors which characterize contacts having the medium-hard magnetic substrate covered by the noble metal contact layer discussed hereinbefore. It is considered that the intermediate layer metal which has a high affinity for oxygen forms a good connection with the substrate surface and also with the anomalies (also referred to as imperfections) without itself completely changing into the oxide form. They also form a boundary layer with the contact material which is a transition zone resulting in good adherence between the outer contact layer and the intermediate layer without increasing the contact resistance to an undesirable extent. The function of the intermediate layer apparently results from a combination of the specific metal of which it is formed together with the specified thickness thereof.

The switch contacts of the present invention are preferably prepared by depositing the intermediate layer over the substrate which includes the anomalies or imperfections in the surface of the substrate, followed by deposition of the outer contact layer, from the gas phase, i.e. vapor deposition. This may be accomplished by vapor deposition at a vacuum (pressure) less than $10^{-3}$ mm Hg, or by sputtering at a pressure of between $10^{-1}$ to $10^{-3}$ mm Hg. The substrate is preferably maintained at a temperature of from about 250° C. to 450° C., with a temperature of about 350° C. preferred.

Figure 1:
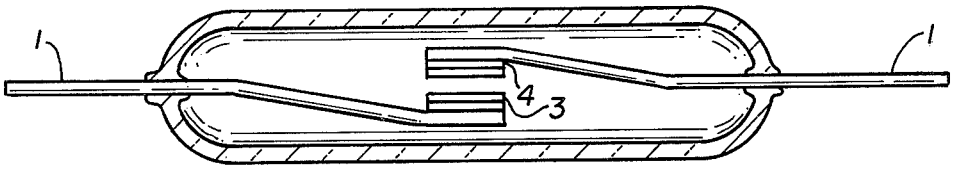

The invention will be described by way of example with reference to the accompanying drawings, FIG. 1 is a cross-section through a sealed low power switch contact, a so called rem-reed relay, rem from remanent, reed from the form of the blades carrying the contacts, and FIG. 2 is a schematic longitudinal section through one contact element of said rem-reed relay.

In FIG. 1, the glass envelope 5 is hermetically sealed by melting the glass around opposed contact carriers or substrates 1. The envelope 5 is evacuated to form a vacuum or is gas filled. Each of the contact carriers 1 has a portion of its inwardly extended end coated with an intermediate layer 4 and an outer contact layer 3, as shown in more detail in FIG. 2.

With reference to FIG. 2, the substrate 1 comprising medium-hard magnetic material contains a number of anomalies 2 having portions thereof protruding from the surface of the substrate 1. A portion of the substrate 1 including anomalies 2 is covered by the intermediate layer 4. Layer 4 may be composed of titanium, zirconium, hafnium, vanadium, niobium and/or tantalum. Layer 4 in turn is covered by the contact layer 3 comprising a noble metal or an alloy of a noble metal, a noble metal base alloy, rhodium or ruthenium.

The method of manufacturing the low-power switch contact of the present invention is illustrated as follows:

A substrate is positioned in a vapor desposition chamber with only the area to be coated exposed to the vapor stream of coating metal. The chamber is evacuated to a pressure of less than $10^{-3}$ mm Hg. The substrate is heated by a suitable heating element, for example by radiant heat, to a temperature of 350° C. Titanium contained within a water-cooled copper crucible is evaporated by bombardment of high-energy electron beams and vapor deposited on the substrate to a thickness of 10 μm and not only heat covers the desirable portion of the substrate but also the anomalies contained on the surface thereof. The material for the outer contact layer, for example ruthenium, is then evaporated from another crucible and vapor desposited on the titanium layer. In order to prevent formation of oxide on the titanium layer, it is preferred that the contact layer should be applied on the intermediate layer, for example the titanium layer, in the same vapor deposition cycle, i.e. without interruption of the vacuum. In addition to the aforedescribed evaporation-vapor deposition process, the vapor-deposited metals, for example, titanium and/or ruthenium, can also be removed from a target by ion bombardement at a negative potential and deposited on the substrate or intermediate layer respectively. Such ions are produced by direct-current voltage or high frequency plasma in an argon atmosphere at a pressure of from $10^{31\ 1}$ to $10^{-3}$ mm Hg.

The aforenoted process was utilized to deposit a titanium intermediate layer (4) 10 μm thick on a substrate of medium-hard magnetic material (1). The titanium layer was then covered with a ruthenium contact layer (3) 3 μm thick. The substrate was a sheet of material 360 μm thick, of "Vacuzet 655" ( alloy of 55% by weight Co, 12% by weight Ni, 3% by weight Ti, 1% by weight Al and the remainder:Fe) delivered by Vacuumschmelze AG, Hanau, Germany, having a coercive field strenght of between 37 and 62 oerstedt according to the conditions of heat treatment or annealing and a remanency of 14 500 Gauss.

We claim:

1. Low-current rem-reed switch contact encased in a housing under vacuum or a protective gas comprising a substrate of medium-hard magnetic material having a coercive field strength of from 20 to 90 Oe containing anomalies on the surface thereof, an intermediate layer of a thickness from 1 to 20 μm coated on at least a portion of said substrate, said intermediate layer consisting of at least one metal selected from the group consisting of titanium, zirconium, hafnium, vanadium, niobium and tantalum, and an outer contact layer between 1 and 10 μm thick on said intermediate layer, said outer contact layer comprising a noble metal or noble metal alloy.

2. The contact of claim 1 wherein said intermediate layer is between 2 and 10 μm thick.

3. The contact of claim 2 wherein said outer contact consists of ruthenium.

4. The contact of claim 3 wherein said intermediate layer consists of titanium.

5. The contact of claim 4 wherein said medium-hard magnetic material contains titanium and aluminum.

6. The contact of claim 4 wherein said medium-hard magnetic material is a cobalt-iron-nickel alloy containing a small amount of titanium and aluminum.

7. The contact of claim 4 wherein said outer contact layer consists of ruthenium.

8. The contact of claim 7 wherein said medium-hard magnetic material is a cobalt-iron-nickel alloy containing a small amount of titanium and aluminum.

9. The contact of claim 4 wherein said outer contact layer is at least one alloy selected from the group consisting of silver alloys and gold alloys.

10. The contact of claim 9 wherein said medium-hard magnetic material is a cobalt-iron-nickel alloy containing a small amount of titanium and aluminum.

11. The contact of claim 1 wherein said outer contact layer consists of ruthenium.

12. The contact of claim 1 wherein said outer contact layer is at least one alloy selected from the group consisting of silver alloys and gold alloys.

13. The contact of claim 1 wherein said medium-hard magnetic material contains titanium.

14. The contact of claim 1 wherein said medium-hard magnetic material contains aluminum.

15. The contact of claim 1 wherein said medium-hard magnetic material is a cobalt-iron-nickel alloy containing a small amount of titanium and aluminum.

* * * * *